US005771610A

United States Patent [19]

McDonald

[11] Patent Number: 5,771,610

[45] Date of Patent: Jun. 30, 1998

[54] FOOTWEAR FOR WATER SPORTS

[75] Inventor: Steve McDonald, Portland, Oreg.

[73] Assignee: Patagonia, Inc., Ventura, Calif.

[21] Appl. No.: 653,542

[22] Filed: May 24, 1996

[51] Int. Cl.[6] ..... A43B 7/06; A43B 7/10

[52] U.S. Cl. ..... 36/116; 36/3 A

[58] Field of Search ..... 36/8.1, 3 R, 3 A, 36/54, 116, 114, 138

[56] References Cited

U.S. PATENT DOCUMENTS

| | | | |
|---|---|---|---|
| 793,095 | 6/1905 | Rapp | 36/54 |
| 1,746,478 | 2/1930 | Howland | 36/8.1 |
| 1,831,396 | 11/1931 | Rosenthal | 36/3 R |
| 3,768,182 | 10/1973 | Powers | 36/114 |
| 4,716,663 | 1/1988 | Steinhauser | 36/114 |
| 5,222,313 | 6/1993 | Dowdy et al. | 36/138 |
| 5,266,062 | 11/1993 | Runckel | 36/8.1 |
| 5,337,493 | 8/1994 | Hill | 36/54 |

FOREIGN PATENT DOCUMENTS

| | | | |
|---|---|---|---|
| 354436 | 8/1931 | United Kingdom | 36/3 A |

*Primary Examiner*—Paul T. Sewell
*Assistant Examiner*—Anthony Stashick
*Attorney, Agent, or Firm*—Blakely Sokoloff Taylor & Zafman LLP

[57] ABSTRACT

An athletic water sports shoe. The water sports athletic shoe features a rubber outsole for a strong grip on wet surfaces. In addition to the rubber outsole, a rubber rand extends the rubber surface to the sides of the shoes such that sides of the wearers foot can be used as gripping surfaces. The sides of the shoes are constructed of a waterproof mesh that allows water to flow in and out of the shoe. The inside of the shoe features a neoprene gasket that forms a water-tight seal around the ankle of the wearer. The water-tight seal around the ankle of the wearer prevents sand from entering the shoe. Furthermore, the neoprene gasket protects the foot from bumps and scrapes.

17 Claims, 3 Drawing Sheets

FOOTWEAR FOR WATER SPORTS

FIELD OF THE INVENTION

The present invention is in the field of athletic footwear. Specifically, the present invention introduces footwear that is specifically designed for various water sports.

BACKGROUND OF THE INVENTION

Several outdoors sporting activities involved a significant amount of contact with water. For example, windsurfing, canoeing, sailing, and kayaking all involve significant amount of contact with water. Significant amounts of clothing has been designed for the wet environments of these activities, however little attention has been paid to the footwear needs of these water sports activities. Participants of water sport activities have three main choices for footwear: existing athletic shoes, wetsuit booties, or no footwear at all. However, all of these solutions have their drawbacks.

Many participants of water sport activities often wear old athletic shoes that they no longer care about. However, constant contact with water destroys most existing athletic shoes. Thus, wearing old athletic shoes is often a temporary solution since the water contact will accelerate the deterioration of the old athletic shoes until they are no longer usable. Furthermore, athletic shoes are not designed for contact with water such that most athletic shoe absorb large amounts of water thus making them heavy and cumbersome. Wet athletic shoes tend to dry very slowly, thus the wearer's foot will be subjected to a cold wet environment for a significant period of time. Feet that are subjected to a cold wet environment for prolonged periods can develop ailments such as trench foot.

Wetsuit booties have been created for some water sports such as SCUBA diving. However, wetsuit booties are mainly designed to keep the wearer warm while swimming in cold water. Wetsuit booties are not designed for normal standing, walking, and running. However, the biggest drawback with wetsuit booties is that wetsuit booties retain water inside the bootie when the wearer exits the water. Thus, the wearer must empty the bootie to prevent the foot ailments caused by prolonged exposure to a cold wet environment as described above.

Wearing no footwear at all subjects the water sports participant to possible foot injuries. For example, windsurfers and kayakers who must often wade through water may cut their feet due to sharp rocks, glass, or coral in the water.

It is therefore desirable to have a athletic shoe that is designed for water sport activities. The water sports athletic shoe must be capable of withstanding constant contact with water.

SUMMARY OF THE INVENTION

It is therefore an object of the present invention to introduce a water sports athletic shoe that is specifically designed for water contact. The water sports athletic shoe features a rubber outsole for a strong grip on wet surfaces. In addition to the rubber outsole, a rubber rand extends the rubber surface to the sides of the shoes such that sides of the wearers foot can be used as gripping surfaces. The sides of the shoes are constructed of a waterproof mesh that allows water to flow in and out of the shoe. The waterproof mesh does not absorb significant amounts of water and dries quickly after being exposed to water. The inside of the shoe features a neoprene gasket that forms a water-tight seal around the ankle of the wearer. The water-tight seal around the ankle of the wearer prevents sand from entering the shoe. Furthermore, the neoprene gasket protects the wearer's ankle from injury due to hitting the internal sides of a kayak boat and protects wearer's foot from abrasion against rocks.

Other objects, features, and advantages of the present invention will be apparent from the accompanying drawings and from the detailed description which follows below.

DETAILED DESCRIPTION OF THE DRAWINGS

Figure 1:
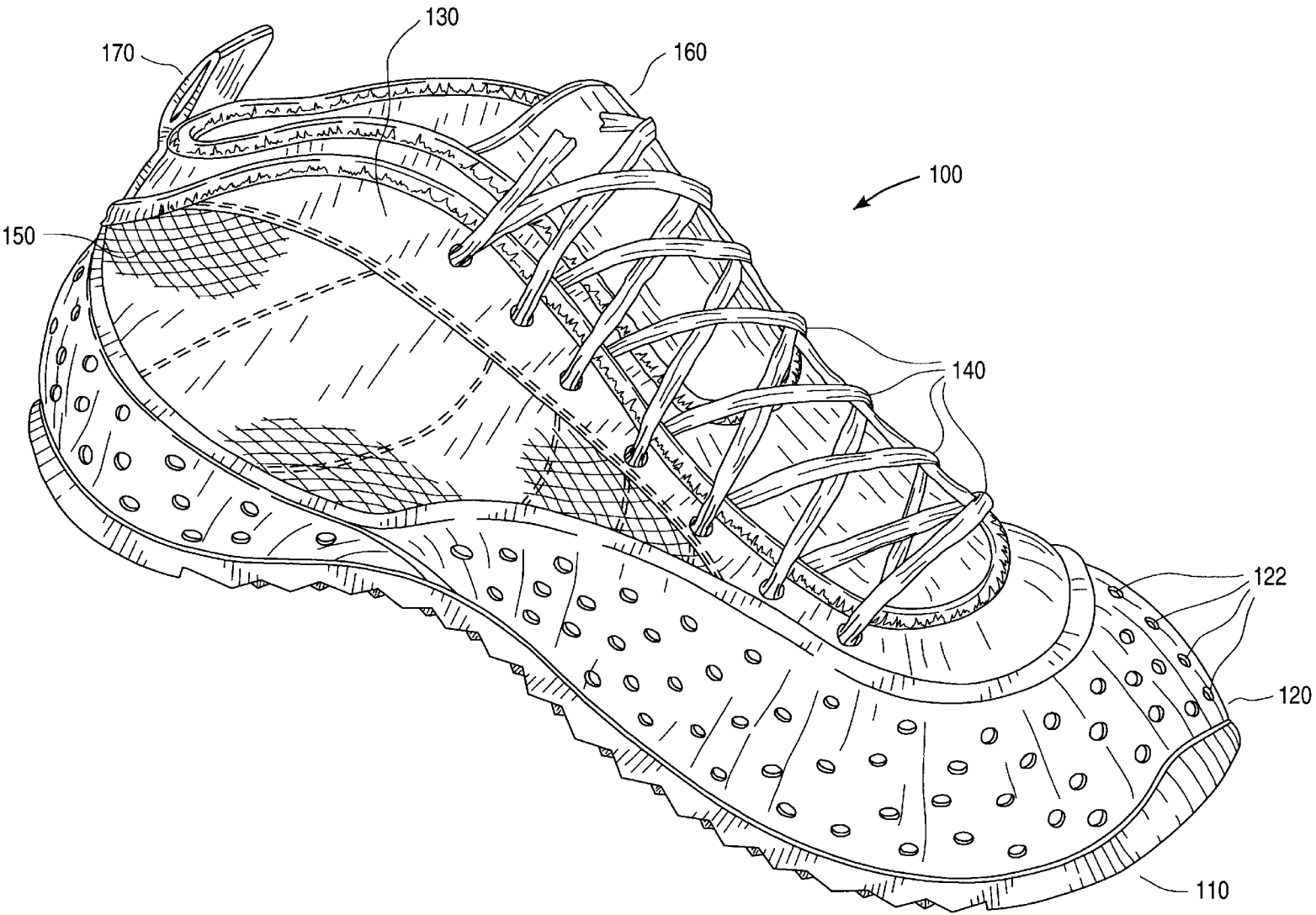

The objects, features and advantages of the present invention will be apparent to one skilled in the art, in view of the following detailed description in which:

FIG. 1 illustrates an oblique view of the water sports shoe according to the teachings of the present invention.

Figure 2A:
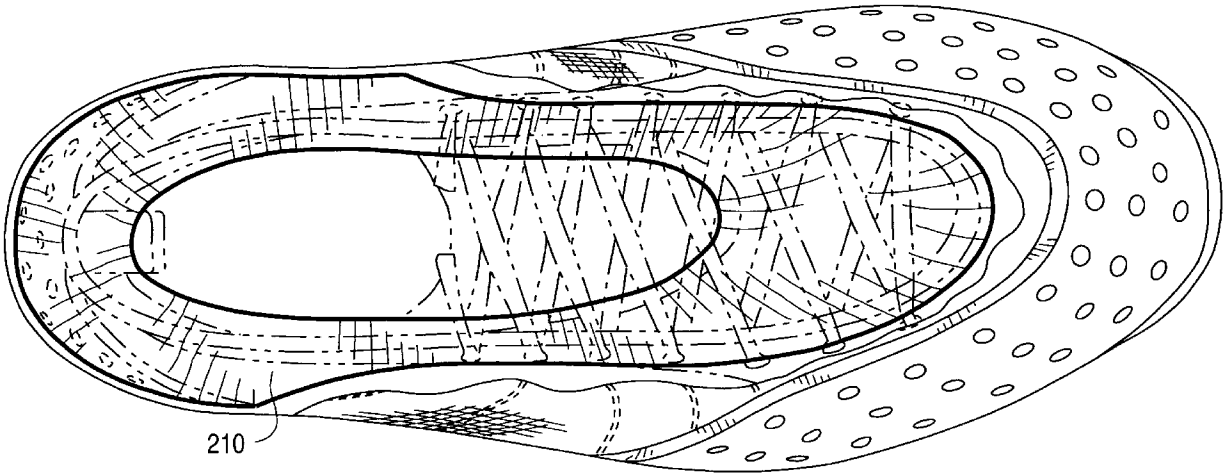

FIG. 2*a* illustrates a cut-away top view of the shoe with the neoprene ankle gasket visible.

Figure 2B:
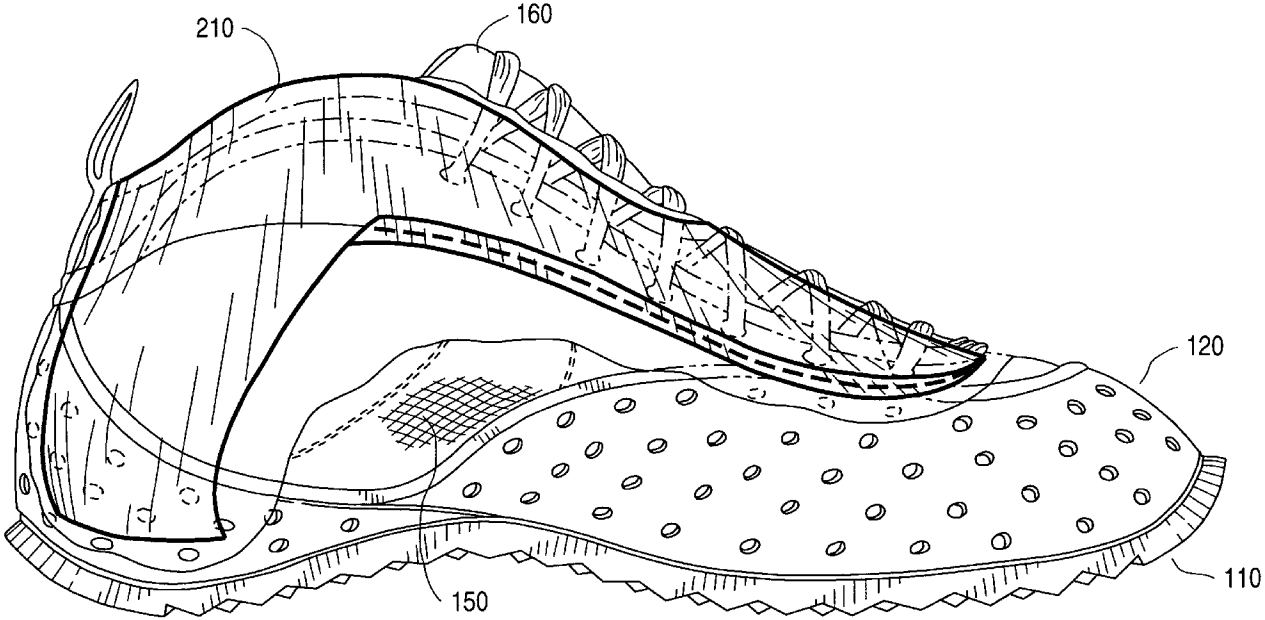

FIG. 2*b* illustrates a cut-away side view of the neoprene ankle gasket visible.

Figure 3A:
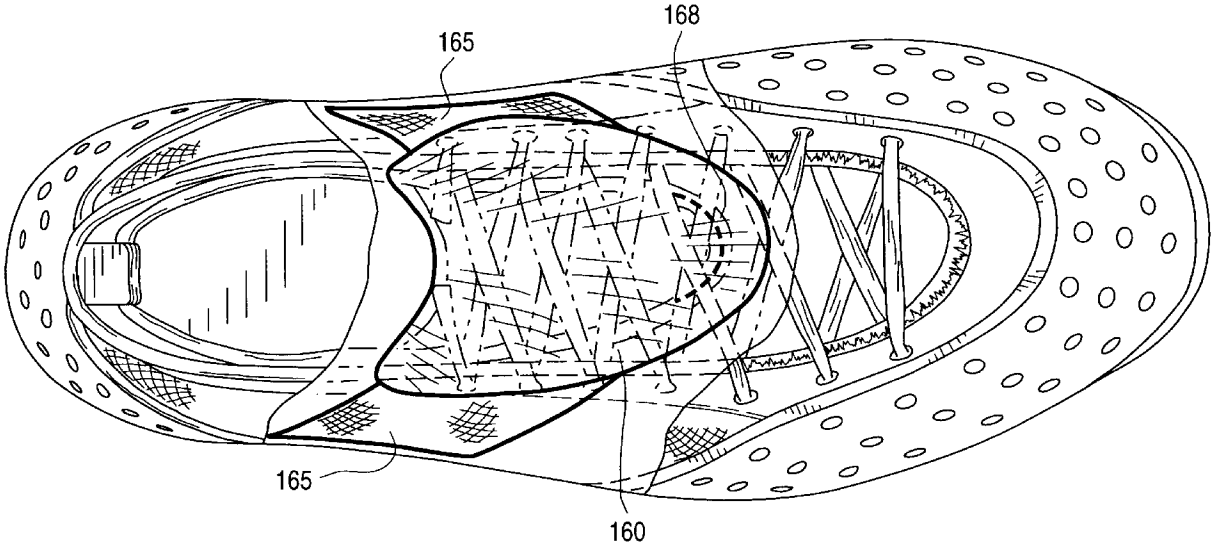

FIG. 3*a* illustrates cut-away view from the top that illustrates the neoprene tongue and retaining straps of the shoe.

Figure 3B:
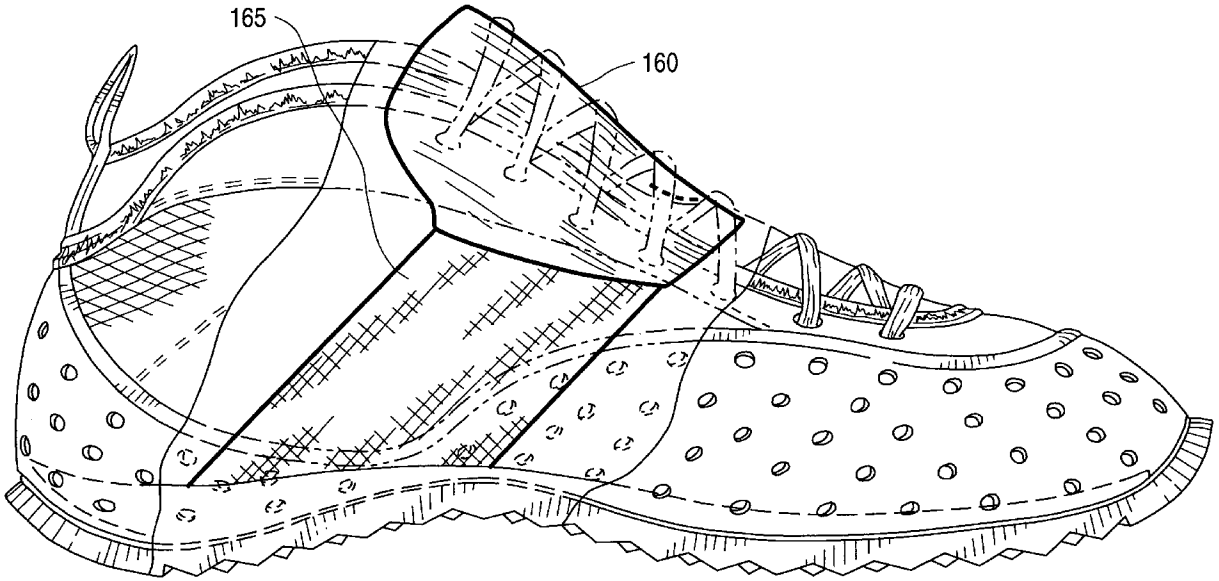

FIG. 3*b* illustrates a cut-away side view that illustrates the neoprene tongue and retaining straps.

DETAILED DESCRIPTION OF THE INVENTION

A piece of footwear designed for water sports is disclosed. In the following description, for purposes of explanation, specific nomenclature is set forth to provide a thorough understanding of the present invention. However, it will be apparent to one skilled in the art that these specific details are not required in order to practice the present invention.

The Water Sports Athletic Shoe

FIG. 1 illustrates an oblique view of the athletic water sports shoe 100 of the present invention. The outer sole 110 of water sport shoe consist of a rubber material. The rubber material of the outer sole 110 is designed to provide the wearer with a good purchase even on slippery wet surfaces. The outer sole has a textured pattern that forces the water away from the sole when the sole contacts a surface.

The outer sole 110 is coupled to an upper rand 120 that is also constructed of a rubber material. The upper rand 120 of the water sports shoe enables the wearer to have additional gripping surfaces extending beyond the sole of the shoe. This allows wearers to use the sides of their feet as gripping surfaces. This feature is similar to the rubber rand of rock climbing shoes. However, the upper rand 120 of the athletic water sports shoe 100 is perforated with a set of drainage holes 122 that allow water to enter into and escape from the water sport shoe 100. Since the outer sole 110 and the upper rand 120 are constructed of rubber, neither part absorbs water.

The lateral surface of the athletic water sport shoe 100 is constructed using a mesh material 150. The mesh material 150 allows water to flow in and out of the athletic water sports shoe 100. However, the mesh material 150 has very small apertures that prevent sand from flowing in and out of the shoe. The mesh material 150 does not absorb a significant amount of water such that the athletic water sports shoe 100 remains light even after being immersed in water.

Near the lace region of the shoe, the mesh material 150 is reinforced with a Benecke™ ceraprene piece 130. Furthermore, the lace holes are encircled with extra stitching. The Benecke™ ceraprene piece 130 and the extra stitching around the lace holes ensure that the shoe laces 140 do not saw through the lace holes.

At the top of the athletic water sport shoe 100 is a neoprene tongue 160 at the front of the opening for the foot. Behind the opening for the foot is a laced grab 170 that helps the wearer quickly put on the shoe.

The Neoprene Ankle Gasket

When wearing shoes in and around water it is very common to get sand and other particles from the water into the shoes. When sand gets into a shoe, the sand can cause abrasions on the feet of the wearer. Thus, it is desirable to prevent the sand from entering the shoe. To prevent sand and other particles from entering the shoe, the present invention introduces a neoprene gasket that seals the shoe such that sand and other particles do not enter the shoe.

FIG. 2*a* illustrates a cut-away top view of the water sport shoe wherein a neoprene gasket 210 is illustrated. The neoprene gasket 210 surrounds the opening of the shoe such that a seal forms around the ankle of the wearer.

FIG. 2*b* illustrates a side cut-away view of the water sports shoe. As can be seen in the side cut-away view of FIG. 2*b* the neoprene gasket 210 extends down to the mid-sole near the heel of the shoe. By extending the neoprene gasket to the mid-sole at the heel, the neoprene gasket can be anchored securely at the heel. Furthermore, by extending the neoprene gasket to the mid-sole at the heel, the wearer's heel will be padded and protected from bumps. This feature is especially important for kayakers who sit with their legs straighten inside a kayak such that the weight of their feet rests on the back of their heels.

The neoprene gasket 210 is also attached to the mesh material 150 at the upper area near the lace holes. However, it can be seen from FIG. 2*b* that the neoprene gasket 210 does not cover the entire area of the mesh material 150 such that water may flow in and out of the shoes at these lateral portions of the shoes.

As illustrated in cut-away top view of FIG. 2*a,* the opening for the neoprene gasket is quite large such that a wearer may easily insert her foot into the opening of the shoe. To seal this opening once the wearer has inserted her foot into the shoe, a neoprene tongue 160 is provided. FIG. 3*a* illustrates a cut-away top view of the athletic water sports shoe wherein a neoprene tongue 160 is illustrated. By comparing FIG. 2*a* and FIG. 3*a* it can be seen that the neoprene tongue fills the front half of the opening in the neoprene gasket 210.

The neoprene tongue 160 is secured to the water sports shoe in three different places. At the front of the neoprene tongue 160, stitching 168 couples the neoprene tongue 160 to the neoprene gasket 210. On the two adjacent sides of the neoprene tongue 160, a lycra or similar elastic band material 165 couples the neoprene tongue 160 to the midsole of the water sport shoe.

To enter the water sport shoe, a wearer simply lifts up the neoprene tongue 160 thereby stretching the lycra 165 such that the opening into the shoe is enlarged. The wearer then inserts her foot into the opening of the shoe. The wearer then releases the neoprene tongue 160 such that the lycra 165 contracts and brings the neoprene tongue 160 into contact with the wearers foot. The neoprene tongue 160 works in conjunction with the neoprene gasket 210 to form a tight seal around the wearer's foot. The tight seal thereby prevents sand from entering the athletic water sports shoe.

In the foregoing specification the invention has been described with reference to a specific exemplary embodiment thereof. It will, however, be evident that various modifications and changes may be made thereto without departing from the broader spirit and scope of the invention as set forth in the appended claims. The specification and drawings are, accordingly, to be regarded in an illustrative rather than restrictive sense.

I claim:

1. A piece of footwear, said footwear comprising:

a sole, said sole comprising a textured surface;

a mesh lateral side, said mesh lateral side having small apertures that prevent the transmission of sand;

an ankle gasket, said ankle gasket comprising a large opening in an elastic material, said opening having a toe end and a heel end; and a tongue, said tongue located within said ankle gasket at said toe end, said tongue cooperating with said ankle gasket to provide a seal around an ankle area of said footwear, wherein lifting of said tongue stretches said elastic material to enlarge said opening in said elastic material.

2. The piece of footwear as claimed in claim 1 wherein said tongue is further attached to said sole using at least one elastic band.

3. The piece of footwear as claimed in claim 1 wherein said ankle gasket is anchored to a heel region of said sole.

4. The piece of footwear as claimed in claim 1 wherein said ankle gasket comprises neoprene.

5. The piece of footwear as claimed in claim 1, said footwear further comprising:

a rubber rand, said rubber rand extending up from said sole to a lateral surface of said footwear.

6. The piece of footwear as claimed in claim 5 wherein said rubber rand is perforated.

7. A method of constructing a piece of footwear, said method comprising the steps of:

molding a sole, said sole comprising a textured surface;

anchoring an ankle gasket to said sole, said ankle gasket comprising an opening in an elastic material;

anchoring a tongue to a front end of said ankle gasket so that lifting of said tongue stretches said elastic material to enlarge said opening in said elastic material, said tongue cooperating with said ankle gasket to provide a seal around an ankle area of said footwear; and covering lateral and medial sides of said footwear with a mesh material, said mesh material having small apertures that prevent the transmission of sand.

8. The method of constructing piece of footwear as claimed in claim 7 comprising the steps of:

anchoring said tongue to a lateral side of said sole using a second elastic material; and anchoring said tongue to a medial side of said sole using a third elastic material.

9. The method of constructing piece of footwear as claimed in claim 7 wherein said elastic material comprises neoprene.

10. The method of constructing piece of footwear as claimed in claim 7 comprising the step of:

surrounding a lower portion of said mesh material with a rubber rand.

11. A piece of footwear, said footwear comprising:

an ankle gasket, said ankle gasket comprising an opening in an elastic material;

a tongue, said tongue coupled to a front end of said opening in said ankle gasket so that lifting of said tongue stretches said elastic material to enlarge said opening in said elastic material, said tongue cooperating with said ankle gasket to provide a seal around an ankle area of said footwear; and a mesh side material, said mesh side material surrounding said ankle gasket.

12. The piece of footwear as claimed in claim 11, said footwear further comprising:

a sole, said sole comprising a rubber textured surface.

13. The piece of footwear as claimed in claim 11, said footwear further comprising:

a sole, said sole having a lateral side and a medial side;

a first tongue retainer, said first tongue retainer coupling said tongue to said lateral said of said sole;

a second tongue retainer, said second tongue retainer coupling said tongue to said medial said of said sole.

14. The piece of footwear as claimed in claim 13 wherein said first tongue retainer and said second tongue retainer comprise lycra.

15. The piece of footwear as claimed in claim 13 wherein said tongue comprises lycra.

16. The piece of footwear as claimed in claim 11 wherein saids ankle gasket comprise neoprene.

17. The piece of footwear as claimed in claim 11, said footwear further comprising:

a laced grab, said laced grab coupled to a rear end of said opening in said ankle gasket.

* * * * *